US007524205B1

(12) United States Patent
Lee

(10) Patent No.: US 7,524,205 B1
(45) Date of Patent: Apr. 28, 2009

(54) CONDUCTING WIRE ANTI-DROP STRUCTURE

(75) Inventor: Tzung-Han Lee, Taipei Hsien (TW)

(73) Assignee: Zippy Technology Corp., Hsin-Tien, Taipei Hsien (TW)

( * ) Notice: Subject to any disclaimer, the term of this patent is extended or adjusted under 35 U.S.C. 154(b) by 0 days.

(21) Appl. No.: 12/145,114

(22) Filed: Jun. 24, 2008

(51) Int. Cl.
*H01R 13/64* (2006.01)

(52) U.S. Cl. ..... 439/372; 439/350

(58) Field of Classification Search ..... 439/345, 439/350, 372, 373
See application file for complete search history.

(56) References Cited

U.S. PATENT DOCUMENTS 4,787,855 A * 11/1988 Finke ..... 439/92
6,273,743 B1 * 8/2001 Wakahara et al. ..... 439/372

FOREIGN PATENT DOCUMENTS

TW 557096 10/2003
TW 572419 1/2004
TW 200746556 12/2007

* cited by examiner

*Primary Examiner*—Khiem Nguyen
(74) *Attorney, Agent, or Firm*—Muncy, Geissler, Olds, & Lowe, PLLC

(57) ABSTRACT

The present invention is related to a conducting wire anti-drop structure for fixing two mutually connected conducting wires, which respectively have a connecting terminal for connecting with each other. The conducting wire anti-drop structure is characterized in that a positioning device is mounted on the connecting terminal of one of the conducting wires and has a positioning portion. The positioning portion is used to connect with a position-limiting device, which has an engaging portion extended from the connecting terminal for engaging with the other connecting terminal so as to limit the connection between the connecting terminals and provide stability.

7 Claims, 8 Drawing Sheets

CONDUCTING WIRE ANTI-DROP STRUCTURE

FIELD OF THE INVENTION

The present invention is related to a conducting wire anti-drop structure, and more particularly to a structure for fixing two mutually connected conducting wires.

BACKGROUND OF THE INVENTION

Generally, the power supply obtains power or signal via a conducting wire, which includes at least a connecting terminal at one end thereof for connecting to the power supply from a power source. In the prior art, the connecting terminal of the conducting wire is simply plugged into the socket of the power supply without any fixing or buckling device, so that if a pulling force or an accidental pulling or vibration is applied to the connecting terminal, or the friction between the connecting terminal and the socket becomes insufficient after multiple times of plugging and pulling, the connection between the connecting wire and the socket might become loose and even come off, which actually might reduce the transmission quality of power or electronic signal or even cause power failure. For electronic devices, such as computer or other precision instruments, instable power transmission or disconnection might cause data losing and also might damage the device itself. Therefore, for stabilizing the connecting between the power supply and the conducting wire, TWP No. 557096, entitled "Power cord positioning structure" disclosed a positioning device mounted on the socket of the power supply, wherein when the conducting wire is connected to the socket, the positioning device can limit the conducting wire therein, and TW Publication No. 200746556, entitled "Power cord anti-drop device for power supply and anti-drop wiring material thereof" also disclosed a similar structure. However, the above mentioned inventions set the positioning structure on the socket of the power supply. For more conveniently connection or extending the connection distance of the power supply, the socket of the power supply can be further improved to become a directly extended power conducting wire, as disclosed in TWP No. 572419, entitled "Power cord fixing module structure". In this patent, a fixing media is utilized to fix a power cord on the housing of an electronic device, wherein the electronic device can be a power supply and the power supply can connect to another power cord through extending out a power cord. However, the connection between power cords lacks an assistant mechanism to fix thereof, and thus, the connection between two power cords might easily become loose so as to cause instable power transmission and even damage the power supply and the electronic device.

SUMMARY OF THE INVENTION

For improving the drawbacks described above, the present invention provides a conducting wire anti-drop structure mounted on the connecting terminal of the conducting wire, wherein the anti-drop structure includes an extended position-limiting device for engaging with and limiting the connecting terminal of another conducting wire, so as to prevent from coming off.

The present invention is related to a conducting wire anti-drop structure for fixing two mutually connected conducting wires, which respectively have a connecting terminal for connecting with each other. The conducting wire anti-drop structure includes a positioning device and a position-limiting device, wherein the positioning device is mounted on the connecting terminal of one of the conducting wires and has a positioning portion, and the position-limiting device has a connecting portion connected to the positioning portion and an engaging portion extended from the connecting portion, wherein the engaging portion has at least an accommodating space whose inner edge has a distance exactly matched to and engaged with an outer edge of the other connecting terminal or the other conducting wire, so as to fix the connection between two conducting wires.

The present invention is advantageous of simple structure, convenient installation and preventing the conducting wire from being loose owing to vibration or inappropriate pulling, so as to effectively avoid the damage caused as the conducting wire becomes loose.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
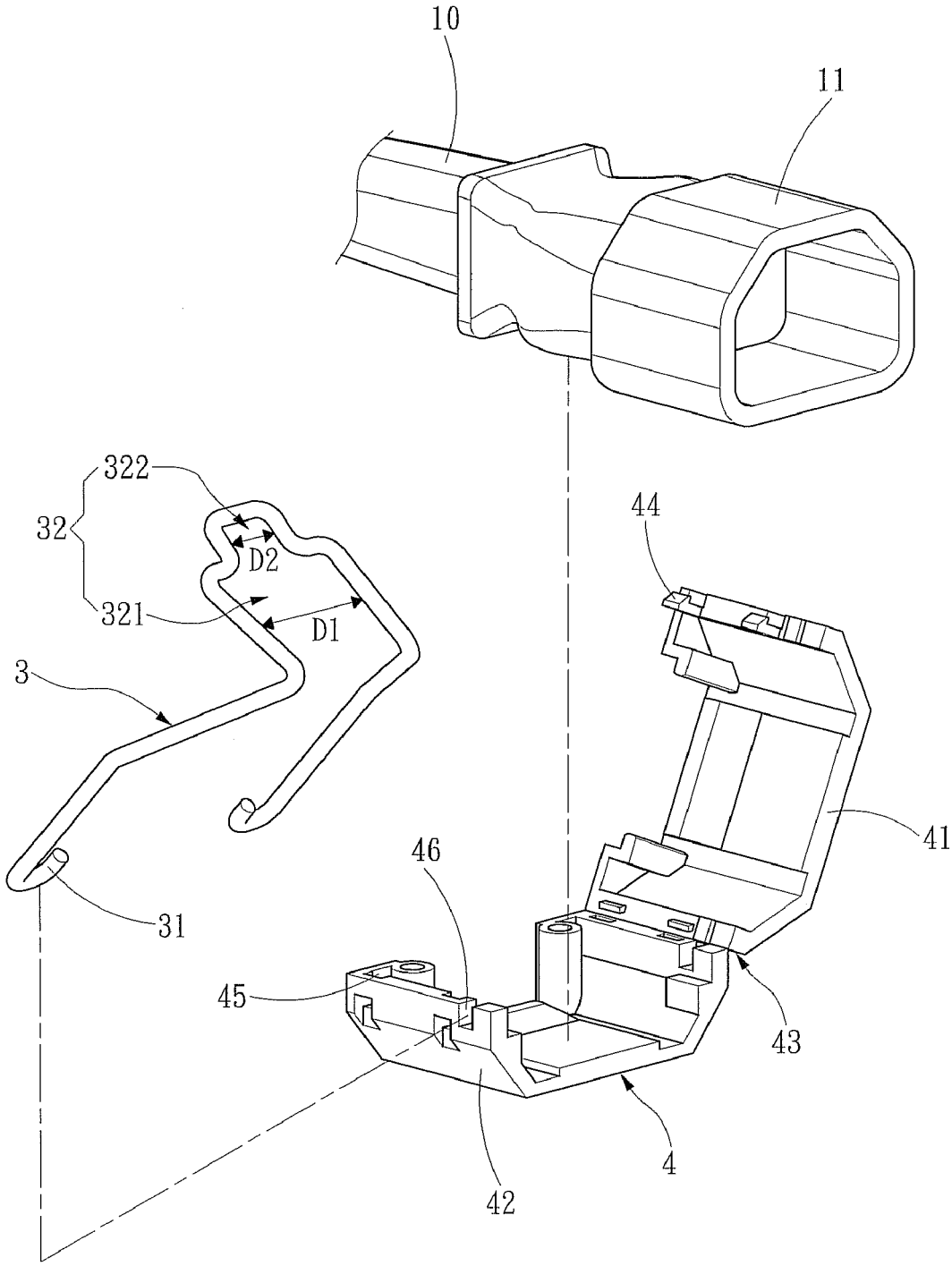
FIG. 1 is a decomposition drawing showing a first embodiment according to the present invention.
Figure 2:
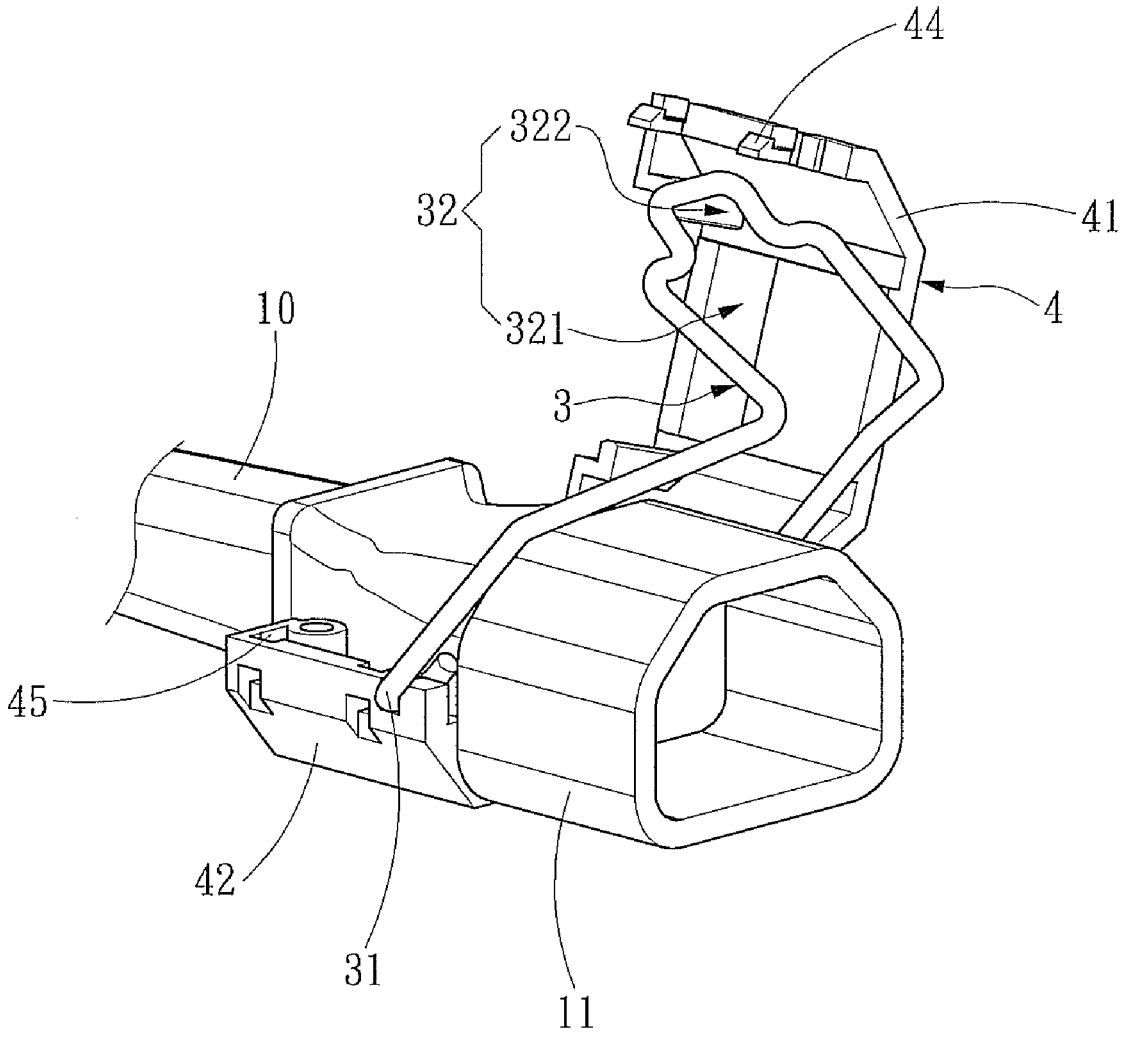
FIG. 2 is a schematic view showing the assembling of a first embodiment according to the present invention.
Figure 3:
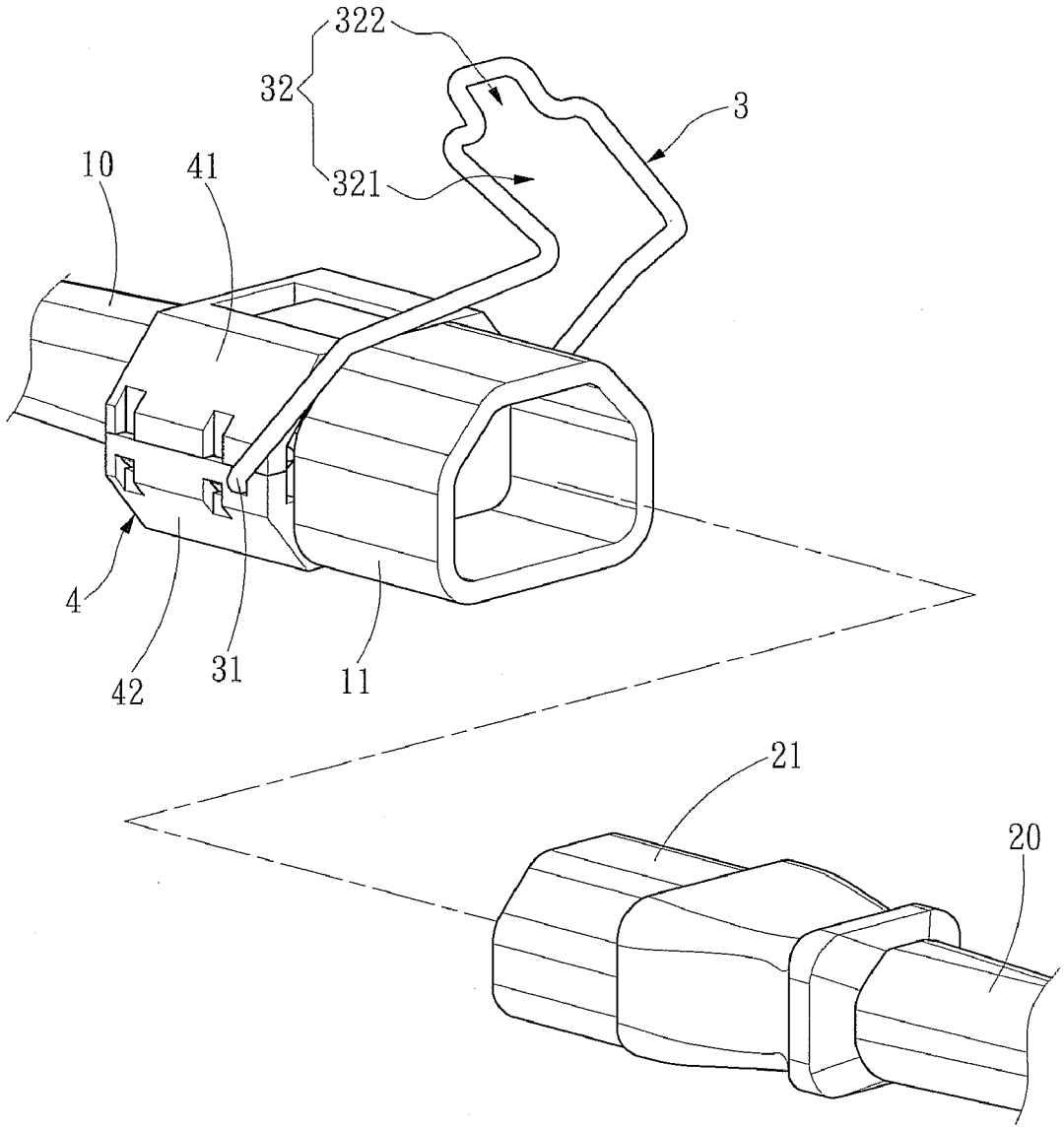
FIG. 3 is a schematic view showing the first moving action of a first embodiment according to the present invention.
Figure 4:
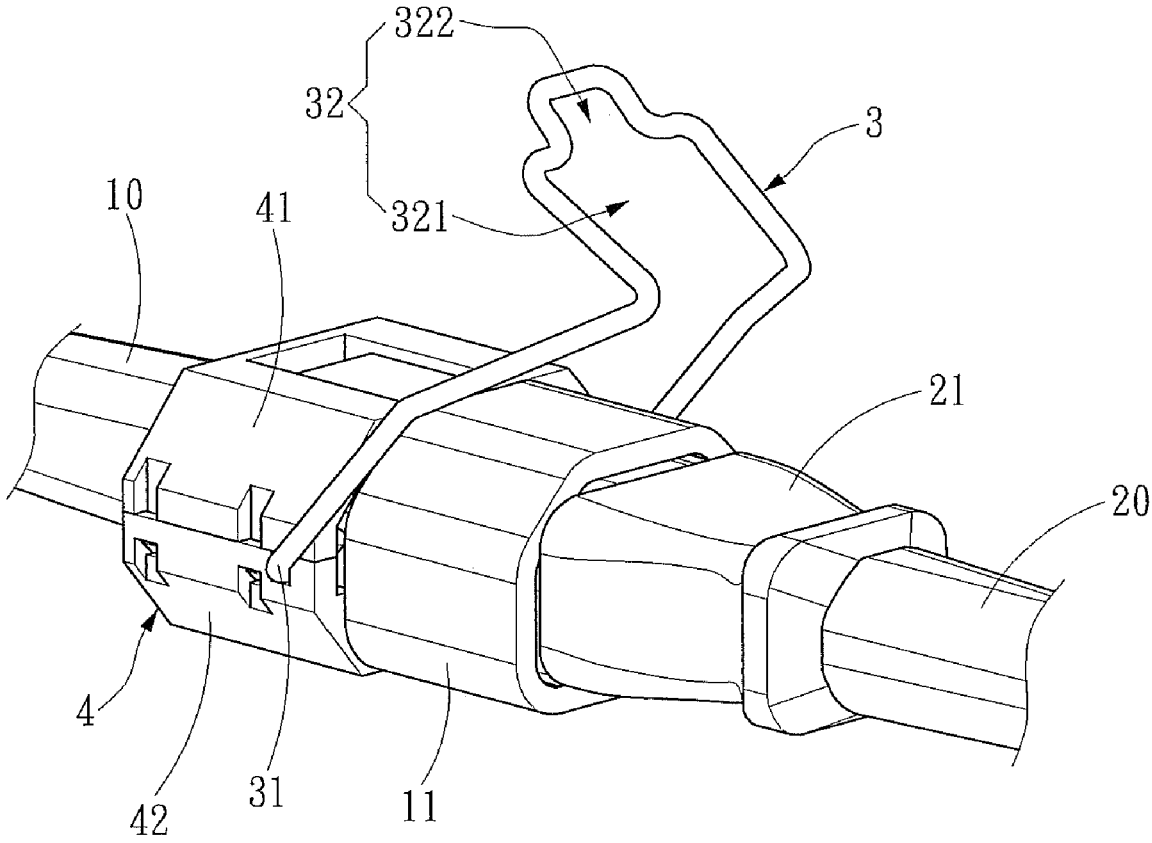
FIG. 4 is a schematic view showing the second moving action of a first embodiment according to the present invention.
Figure 5:
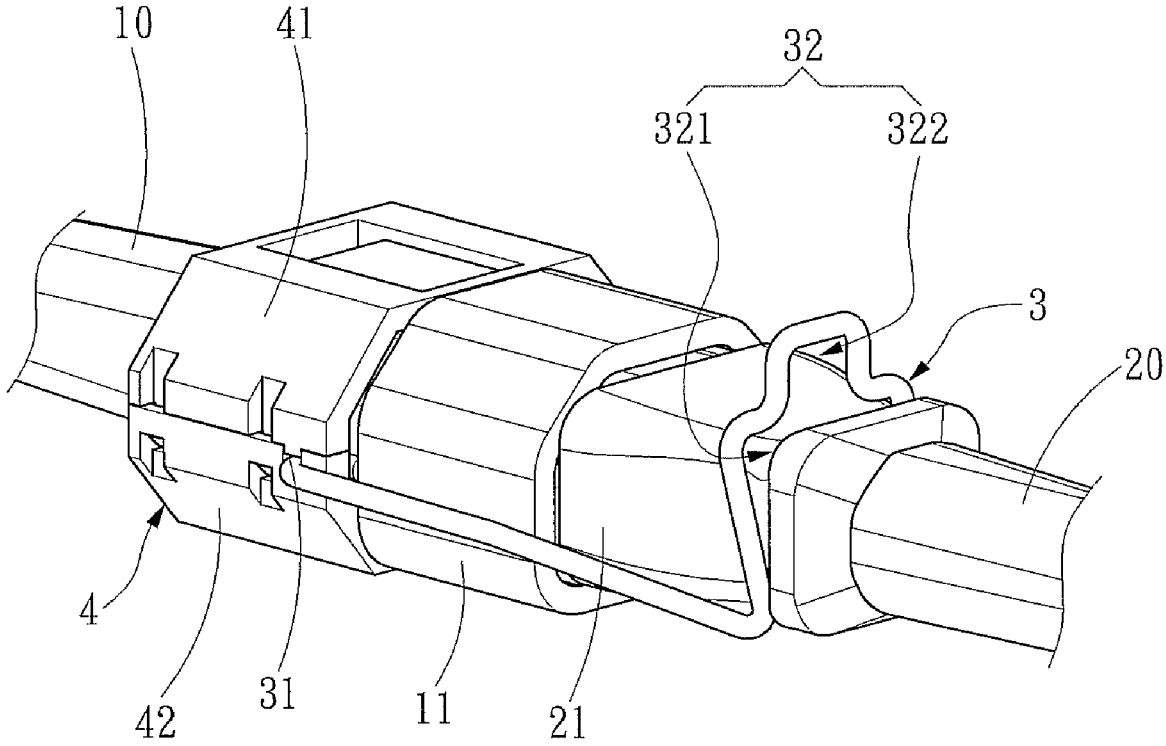
FIG. 5 is a schematic view showing the third moving action of a first embodiment according to the present invention.
Figure 6:
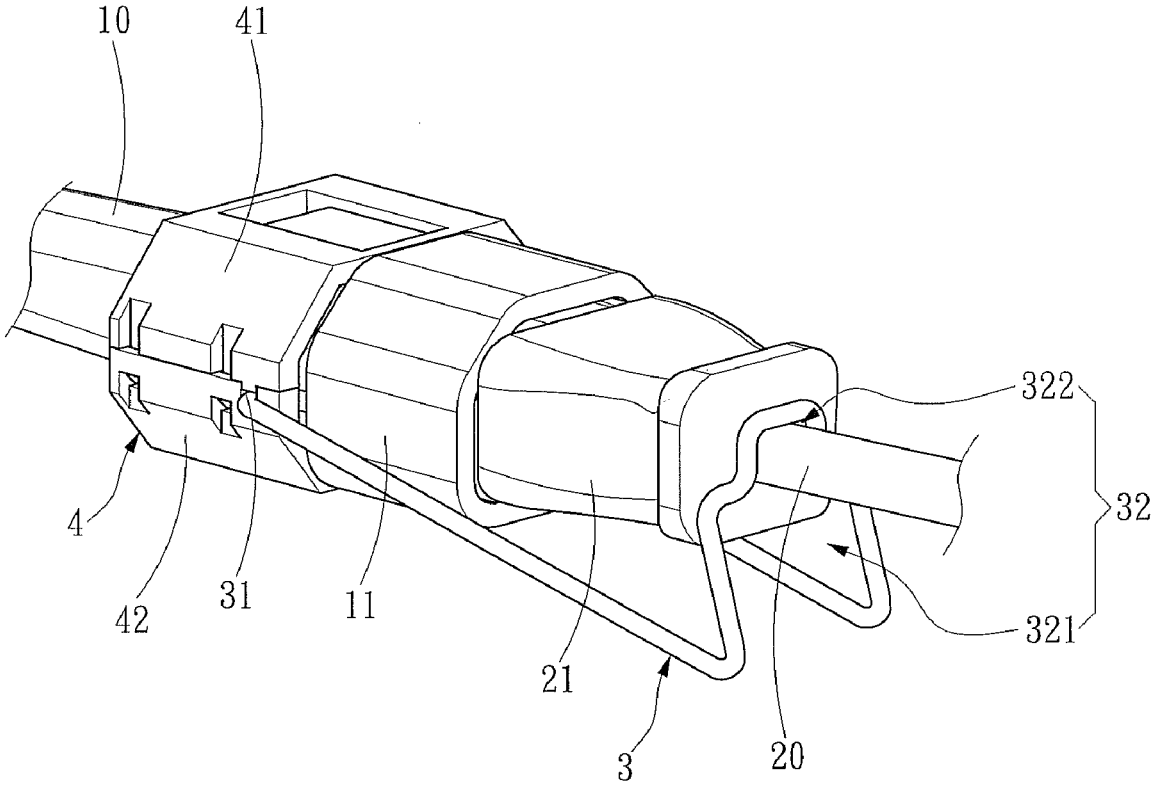
FIG. 6 is a schematic view showing the fourth moving action of a first embodiment according to the present invention.

Please refer to FIG. 1, FIG. 2 and FIG. 3 which shows an embodiment of the present invention. The present invention is related to a conducting wire anti-drop structure for fixing two mutually connected conducting wires 10, 20 (as shown in FIG. 3), and the two conducting wires 10, 20 respectively have a connecting terminal 11, 21. The connecting terminal 11 is connected to a position-limiting device 3 through a positioning device 4, wherein the positioning device 4 includes an tipper housing 41 and a lower housing 42, and the upper and the lower housings 41, 42 are connected through a pivot portion 43. Moreover, the upper housing 41 and the lower housing 42 respectively have an integrating portion 44, 45 at the end opposite to the pivot portion 43, and the upper and the lower housings 41, 42, through the integrating portions 44, 45, are buckled together to form a ring shape for sleeving on the connecting terminal 11 of the conducting wire 10. Furthermore, the positioning device 4 has a positioning portion 46 connecting to the position-limiting device 3, thereby the connecting terminal 11 can connected to the position-limiting device 3 through the positioning device 4. The position-limiting device 3 has a connecting portion 31 for connecting to the positioning portion 46, and the position-limiting device 3 is fixed to the connecting terminal 11 through the positioning device 4. The connecting portion 31 has an engaging portion 32 extended therefrom, wherein the engaging portion 32 is formed to have at least an accommodating space, whose inner edge can exactly match to the outer edge of the connecting terminal 21 or the conducting wire 20 connecting to the conducting wire 10. As shown, the engaging portion 32 of the position-limiting device 3 has a first accommodating space 321, whose inner edge has a distance D1 exactly matched and engaged to the connecting terminal 21 of the conducting wire 10, and the first accommodating space 321 is shrunk to form a second accommodating space 322 whose inner edge has a distance D2 exactly matched and engaged to the outer edge of the conducting wire 20. Please refer to FIG. 3 to FIG. 5, wherein the position-limiting device 3 is connected to the connecting terminal 11 of the conducting wire 10 through the positioning device 4. When the connecting terminal 11 is assembled with the connecting terminal 21 of another conducting wire 20, the extended engaging portion 32 of the position-limiting device 3 is moved to the connecting terminal 21, so that the connecting terminal 21 is engaged by and limited within the first accommodating space 321, thereby the movement of the connecting terminal 21 is limited by the engaging portion 32 so as to achieve the anti-drop function for connecting terminals 21, 11. Furthermore, the engaging portion 32 also can be engaged with the conducting wire 20, as shown in FIG. 6. The length of the engaging portion 32 can be lengthened for reach the conducting wire 20, and here, the inner distance D2 of the second accommodating space 322 is exactly matched to the outer edge of the conducting wire 20, so that the connecting terminal 21 of the conducting wire 20 can be limited between the connecting terminal 11 and the engaging portion 32, thereby simultaneously preventing the connecting terminals 21, 11 from coming off.

Figure 7:
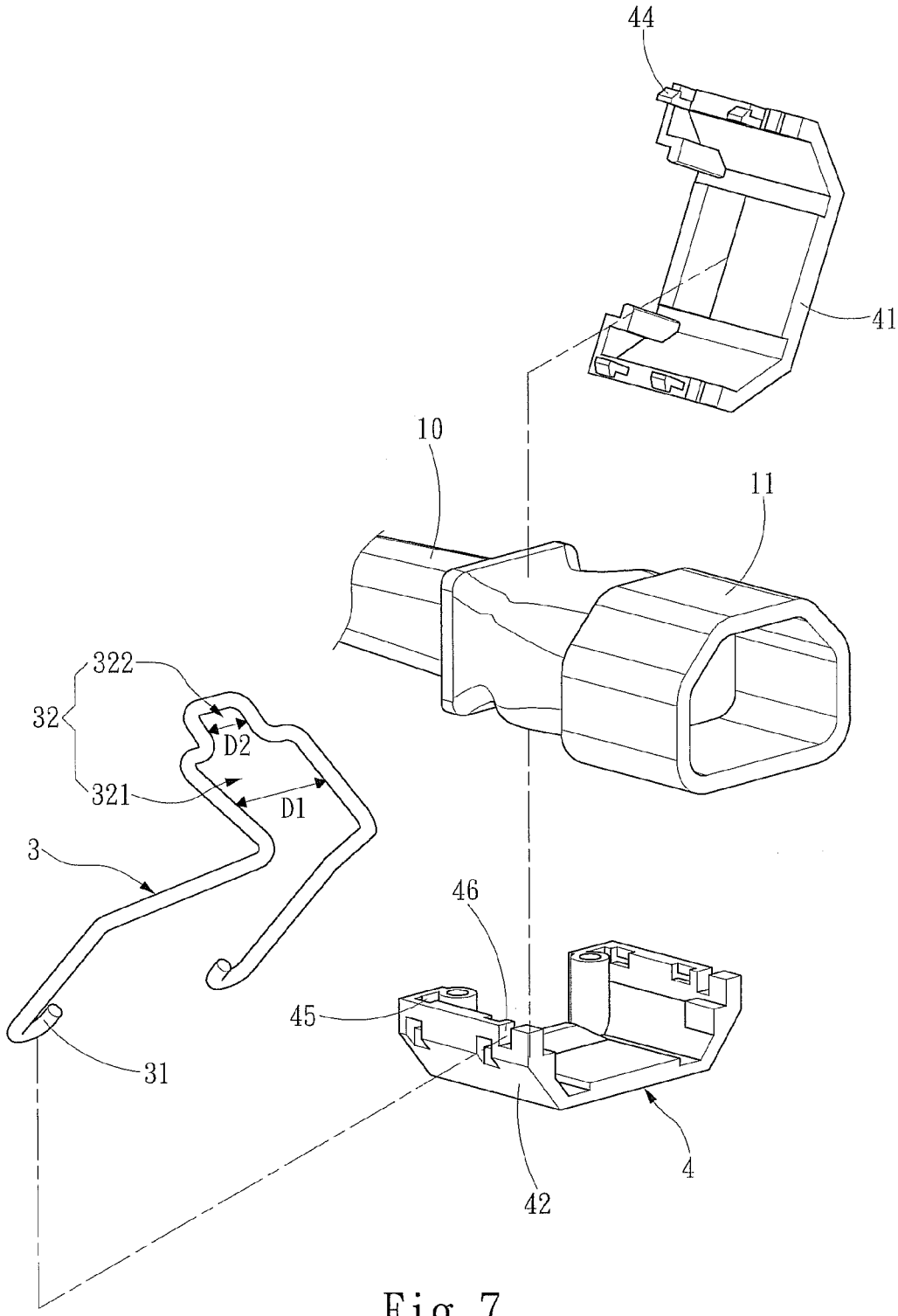
FIG. 7 is a decomposition drawing showing a second embodiment according to the present invention.

Please refer to FIG. 7 which shows a second embodiment of the present invention. As shown, the positioning device 4 is composed of separated upper housing 41 and lower housing 42, wherein the upper housing 41 and the lower housing 42 respectively have integrating portions 44, 45, which are oppositely connected together, so that the upper and the lower housings 41, 42 can be connected together at two sides of the connecting terminal 11, and thus, the position-limiting device 3 is connected to the conducting wire 10.

Figure 8:
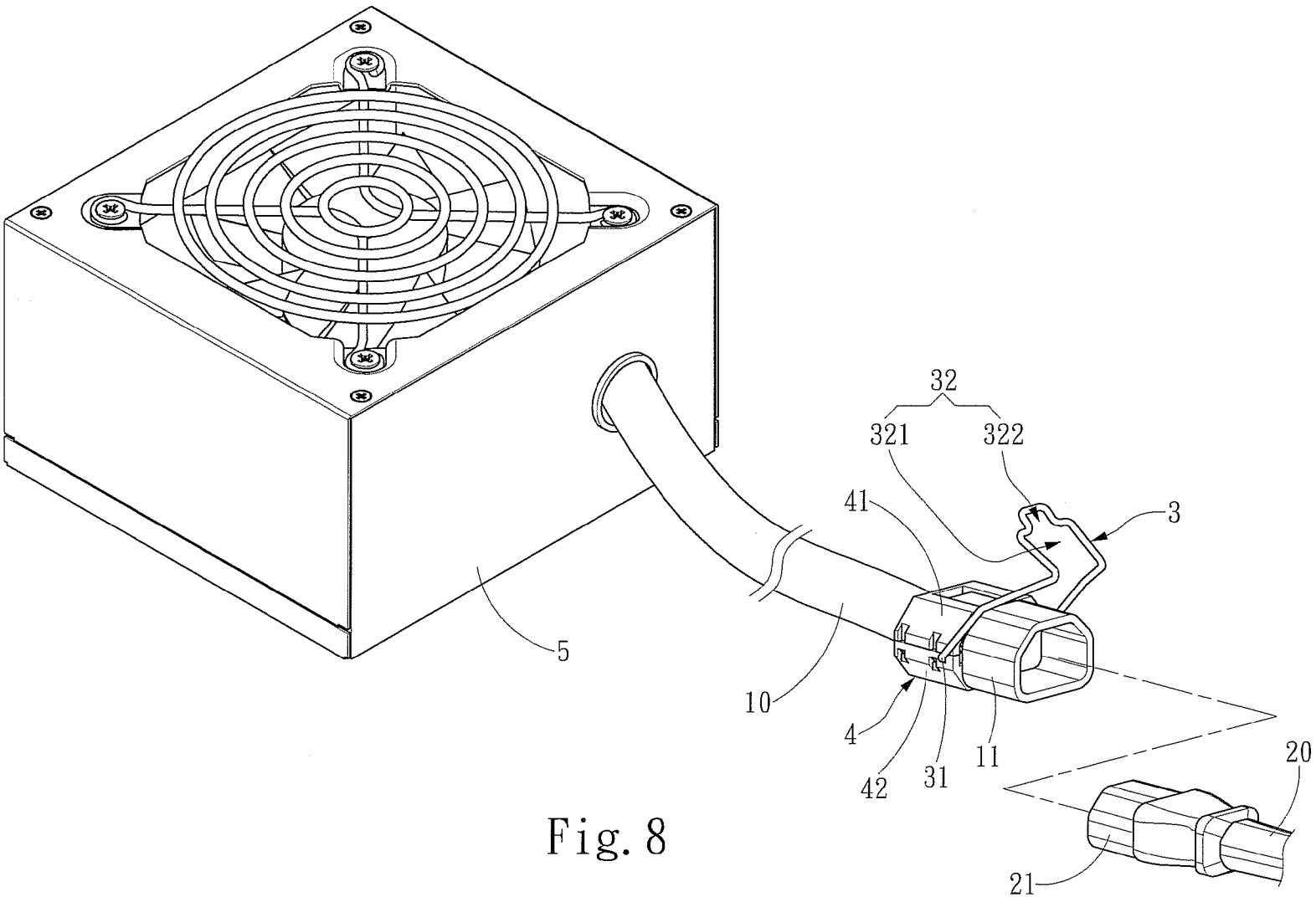
FIG. 8 is a three-dimensional drawing showing the application of the present invention.

Although in the embodiments described above, the conducting wire 10 with the position limiting device 3 and the positioning device 4 has connecting terminal at both ends, the conducting wire 10 also can be fixedly mounted on the power supply. Please refer to FIG. 8, in which one end of the conducting wire 10 with the position limiting device 3 and the positioning device 4 is formed to be a connecting terminal 11 and the other end is fixedly connected to a power supply 5, so that the power supply 5 can stably connected to another conducting wire 20 or other electronic instruments.

In the embodiments described above, the position-limiting device 3 can be made of flexible or elastic material, so that when the position-limiting device 3 is buckled on the connecting terminal 21 or the connecting terminal 11, the flexibility can apply pressure to the connection so as to improve the fixity.

In the aforesaid, the present invention is advantageous of simple structure, convenient installation and preventing the conducting wire from being loose owing to vibration or inappropriate pulling, so that the damage that might be caused as the conducting wire becomes loose can be effectively avoided, thereby improving the stability.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A conducting wire anti-drop structure for fixing two mutually connected conducting wires, which respectively have a connecting terminal for connecting with each other, comprising:

a positioning device, mounted on the connecting terminal of one of the conducting wires and having a positioning portion; and a position-limiting device, having a connecting portion connected to the positioning portion and an engaging portion extended from the connecting portion, wherein the engaging portion at least has an accommodating space whose inner edge has a distance exactly matched to and engaged with an outer edge of the other connecting terminal or the other conducting wire, so as to fix the connection between two conducting wires.

2. The conducting wire anti-drop structure as claimed in claim 1, wherein the accommodating space of the engaging portion is divided into a first accommodating space and a second accommodating space which is formed by shrunk the first accommodating space, wherein the inner edges of the first accommodating space and the second accommodating space are respectively matched to and engaged with the outer edge of the connecting terminal or the conducting wire.

3. The conducting wire anti-drop structure as claimed in claim 1, wherein the positioning device is assembled by an upper housing and a lower housing which are separated from each other, and the upper and lower housings respectively have an integrating portion for oppositely integrated with each other, such that the upper housing and the lower housing are connected together at two ends of the connecting terminal.

4. The conducting wire anti-drop structure as claimed in claim 1, wherein the positioning device is assembled by an tipper housing and a lower housing which are formed integrally, wherein a pivot portion is connected between the upper and the lower housings and the upper and the lower housings respectively have an integrating portion at the end opposite to the pivot portion, so that the upper and the lower housings are buckled together through the integrating portions to form a ring shape so as to sleeve on the connecting terminal of the conducting wire.

5. The conducting wire anti-drop structure as claimed in claim 1, wherein the conducting wire with the positioning device and the position-limiting device has the connecting terminals mounted at both ends thereof.

6. The conducting wire anti-drop structure as claimed in claim 1, wherein one end of the conducting wire mounted with the positioning device and the position-limiting device has the connecting terminal mounted thereon and the other end is fixedly connected to a power supply.

7. The conducting wire anti-drop structure as claimed in claim 1, wherein the position-limiting device is made of elastic or flexible material.

* * * * *